US005947801A

United States Patent [19]

Weber

[11] Patent Number: 5,947,801

[45] **Date of Patent: *Sep. 7, 1999**

[54] PRESSURE BAR FOR A BELT GRINDING MACHINE

[76] Inventor: George Weber, Friesener Strasse 27, 96317 Kronach, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/037,649

[22] Filed: Mar. 10, 1998

[30] Foreign Application Priority Data

Apr. 9, 1997 [DE] Germany ..... 197 14 672

[51] Int. Cl.[6] ..... B24B 21/00

[52] U.S. Cl. ..... 451/303; 451/296

[58] Field of Search ..... 451/41, 168, 285, 451/286, 287, 288, 289, 141, 303, 24, 296, 299, 302

[56] References Cited

U.S. PATENT DOCUMENTS

| | | | |
|---|---|---|---|
| 4,606,151 | 8/1986 | Heynacher | 451/168 |
| 4,802,309 | 2/1989 | Heynacher | 451/41 |
| 4,850,152 | 7/1989 | Heynacher et al. | 451/168 |
| 5,016,400 | 5/1991 | Weber | 451/303 |
| 5,230,184 | 7/1993 | Bukhman | 451/41 |
| 5,472,374 | 12/1995 | Yamada | 451/303 |
| 5,613,901 | 3/1997 | Weber et al. | 451/303 |
| 5,625,299 | 4/1997 | Shendon | 451/288 |
| 5,643,053 | 7/1997 | Shendon | 451/288 |
| 5,733,182 | 3/1998 | Muramatsu et al. | 451/288 |
| 5,762,539 | 6/1998 | Nakashiba et al. | 451/288 |

*Primary Examiner*—David A. Scherbel
*Assistant Examiner*—Derris Holt Banks
*Attorney, Agent, or Firm*—McCormick, Paulding & Huber LLP

[57] ABSTRACT

A pressure bar for a belt grinding machine includes an elongated carrier (10) with a base plate (12) facing the grinding belt (20) and having a plurality of bores arranged in a matrix pattern, in which bores axially freely movable bolt-shaped pressure members (16) are held. The pressure members have free ends for engagement with the grinding belt (20). A plurality of positioning devices (26) are arranged next to one another in the longitudinal direction of the carrier (10) with each having a ram adjustable perpendicularly to the base plate (12) to groupwise position the pressure members (16) in their bores. Between the ends of the pressure members (16) remote from the grinding belt (20) and the rams (28) of the positioning devices (26) is arranged an elastic lamina (22) common to all of the pressure members and extending parallel to the longitudinal direction of the carrier. Each ram (28) is associated with an essentially rigid pressure piece (24) extending over the width of the lamina (22) perpendicularly to the longitudinal direction of the carrier. Each pressure piece (24) is connected with the lamina (22) and has a spacing from its neighboring pressure pieces (24) which is smaller than the diameter of one bolt-shaped pressure member (16).

4 Claims, 2 Drawing Sheets

PRESSURE BAR FOR A BELT GRINDING MACHINE

FIELD OF THE INVENTION

The invention concerns a pressure bar for a belt grinding machine including an elongated carrier with a base plate facing the grinding belt and having a plurality of bores arranged in matrix fashion in which bores axially freely movable pressure members are held, which members are intended to engage the grinding belt with their free ends, and a plurality of positioning devices arranged next to one another in the longitudinal direction of the carrier, with each device having a ram adjustable perpendicularly to the base plate, for groupwise positioning the pressure members in their bores.

BACKGROUND OF THE INVENTION

One such pressure bar is known, for example, from EP-A-389 914. In the known solution, the pressure members are urged in the direction toward the grinding belt through a hose actuatable by a pressure medium. The hose is surrounded by a plurality of frame-shaped pressure shoes arranged next to one another in the longitudinal direction of the carrier and each shoe is positionable perpendicularly to the base plate by means of a positioning device. The pressure shoes have in their frame sides which face the base plate bores registering with bores in the base plate for receiving the pressure members with a flexible pressure distribution element being arranged between the hose and the ends of the pressure members facing the hose, the pressure distribution element having a higher stiffness than the hose material. This pressure bar has proved itself in practice with belt grinding machines, especially for the deburring and descaling of large sheet metal pieces. Above all, it has been shown that the stiffness of the arrangement is still relatively high and that the resolution with the actuation of the pressure members is less than could be wished for.

SUMMARY OF THE INVENTION

The invention has as its object the formation of a pressure bar of the known kind which is of simple construction and which as well has a higher flexibility and a higher resolution.

This object is solved in accordance with the invention in that between the ends of the pressure members remote from the grinding belt and the rams of the positioning mechanisms an elastic lamina is arranged which extends parallel to the longitudinal direction of the carrier and which is associated in common with all of the pressure members, and in that each ram has associated with it an essentially rigid pressure piece which extends perpendicular to the longitudinal direction of the carrier over the width of the lamina, the pressure piece being connected with the lamina, being spaced from its neighboring pressure pieces, and being smaller than the diameter of one of the bolt-shaped pressure members.

In the solution of the invention, the pressure hose and the frame-shaped pressure shoes surrounding the pressure hose are omitted. Thereby not only is the construction of the pressure bar simplified, but the flexibility of the arrangement and the resolution by the positioning of the pressure members are also increased. In the known solution, the hose has a relatively high stiffness and the width of the frame-shaped pressure shoes cannot exceed a certain measurement. In contrast to this, in the solution of the invention the lamina can be made more flexible than the pressure hose. The width of the pressure pieces can in principle be chosen to be the same as the diameter of the bolt-shaped pressure members. Therefore, since the rams of the positioning devices require little space, the resolution can be considerably increased with the pressure bar of the invention.

The lamina can, for example, consist of spring steel. In an especially simple solution, the pressure pieces are adhesively bonded to the lamina. The rams of the positioning devices do not have to be mechanically connected with the pressure pieces. Therefore, the result is an extremely simple construction of the pressure bar.

BRIEF DESCRIPTION OF THE DRAWINGS

The following description explains the invention in association with the accompanying drawings by way of an exemplary embodiment. The drawings are.

DESCRIPTION OF THE PREFERRED EMBODIMENT

Figure 1:
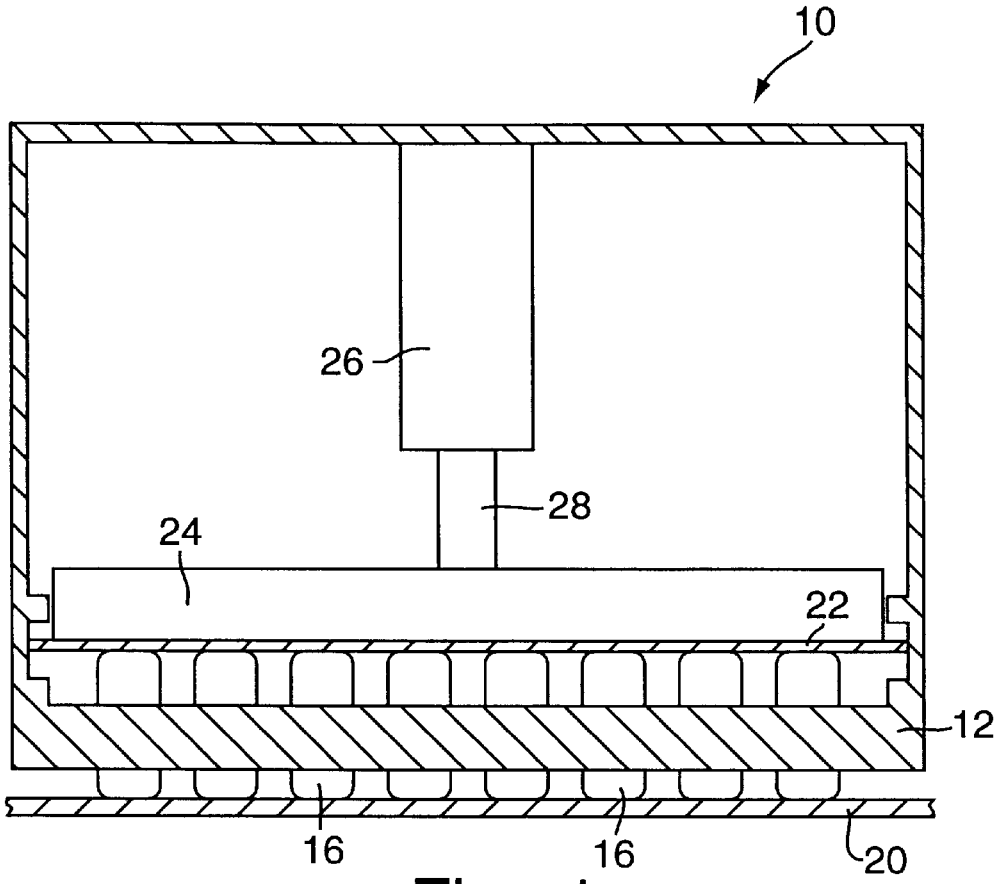
FIG. 1—a schematic cross-section through a pressure bar of the invention perpendicular to the longitudinal direction of the same, FIG. 2—a plan view of a portion of the base plate of the pressure bar, and FIG. 3—a schematic front view of a portion of the pressure bar for explaining the control of the pressure members.
Figure 2:
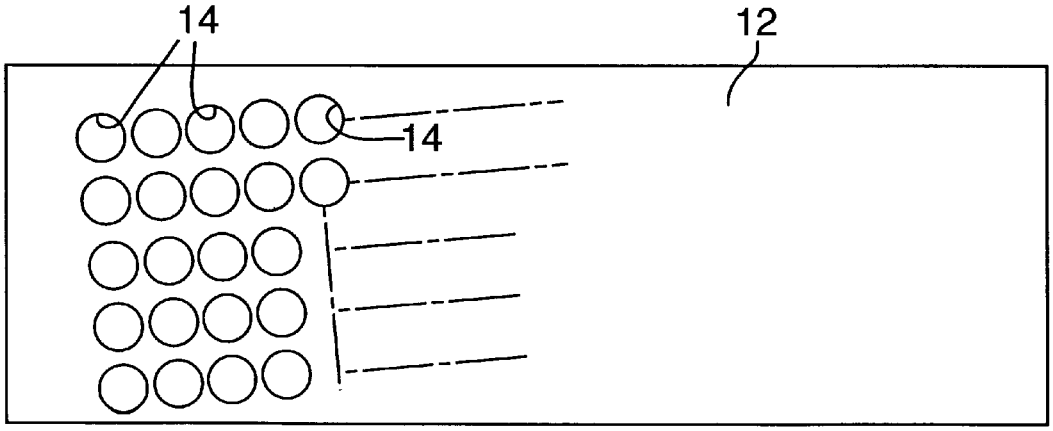
Figure 3:
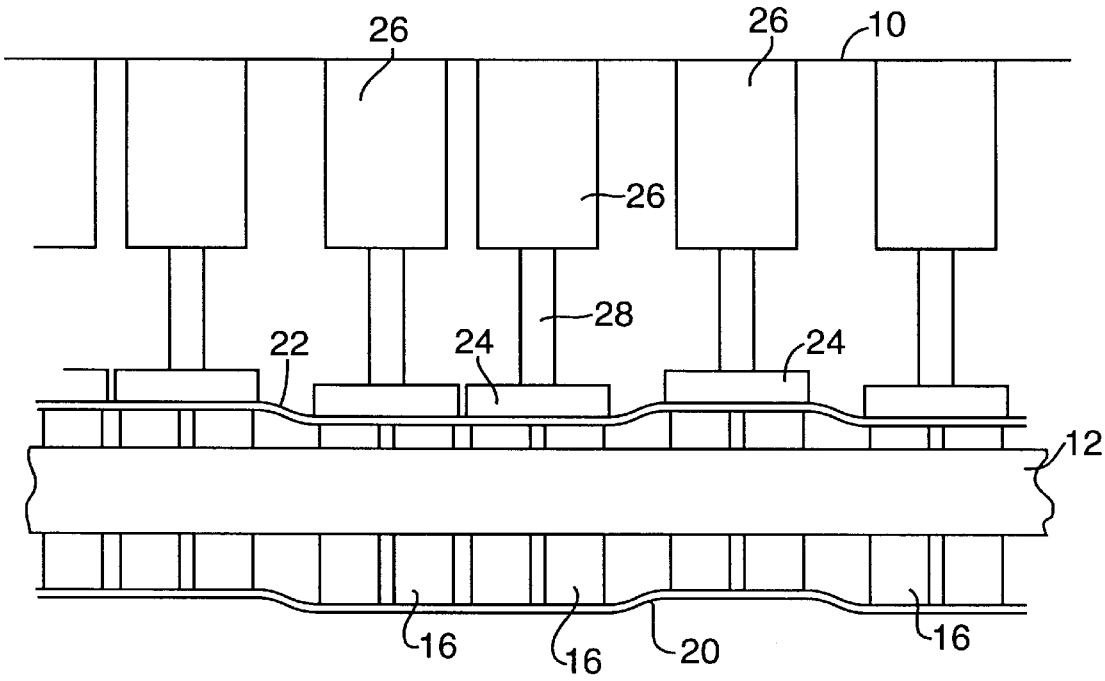

The pressure bar of the invention includes a box-shaped carrier 10 of essentially rectangular cross-section, which on its lower side is closed by a base plate 12. As seen in FIG. 2, the base plate 12 has a plurality of bores 14 in which bolt-shaped pressure members 16 are supported for free axial movement. The bore arrangement corresponds to the arrangement illustrated in the above-mentioned EP-A-389914.

The bolt-shaped pressure members 16 lie with their lower ends directly engaging the rear side of a grinding belt 20. A spring steel lamina 22 lies on the upper ends of the pressure members 16 with the lamina extending over the entire surface of the base plate 12. Small rectangular pressure pieces 24 are adhesively bonded to the spring lamina with the pieces 24 being rigid and extending transversely to the longitudinal direction of the pressure bar. The width of the pressure pieces 24 corresponds at least to the diameter of one pressure member. The lateral spacing between the opposite sides of two pressure pieces 24 is smaller than the diameter of one pressure member.

Each pressure piece 24 is associated with one positioning device, formed by a pressure medium actuatable positioning cylinder 26 arranged on the frame 10, the piston rod or ram 28 of which can work directly on the associated pressure piece 24 with its free end.

If the positioning mechanisms 26 are not actuated, the tension of the grinding belt 20 holds the bolt-shaped pressure members 16 in an upper position. By actuation of the positioning devices 26, 28, the pressure pieces 24 associated with the positioning devices are also actuated and with this the pressure members 16 lying under those pressure pieces 24 are pushed out of the base plate 12, so that in these areas, it is possible that the grinding belt can be pressed against a workpiece. The flexibility of the lamina 22 and the small width of the pressure pieces 24 allows a small incremental precise adjustment of the pressure members 16 in dependence on the position and shape of a workpiece to be ground. The control of the positioning devices 26, 28 in dependence on the position and shape of the workpiece to be ground can thereupon take place in a way known in itself, as that described in the already cited EP-A-389 914.

I claim:

1. A pressure bar for a belt-grinding machine having a grinding belt, said pressure bar comprising:

an elongated carrier (10) having a longitudinal direction and having a base plate (12) facing the grinding belt (20), said base plate having a plurality of bores (14) arranged in a matrix pattern, a plurality of rigid bolt-shaped pressure members (16) axially freely movably held in said bores, said pressure members having diameters and having free ends for engagement with the grinding belt (20), a plurality of positioning devices (26) arranged next to one another in the longitudinal direction of said carrier (10) and each having a ram (28) adjustable perpendicularly to the base plate (12) to groupwise position the pressure members (16) in their bores (14), said pressure members (16) having ends remote from said grinding belt (20), a thin spring lamina made entirely of solid material and having an upper face and a lower face and a width perpendicular to the longitudinal direction of said carrier, said spring lamina extending parallel to the longitudinal direction of said carrier in common over all of said pressure members with said lower face in engagement with said remote ends of said pressure members, and a plurality of generally rigid pressure pieces (24), each of which pressure pieces is located between a respective one of said rams (28) and said upper face of said spring lamina, and which pressure pieces extend perpendicularly to the longitudinal direction of said carrier over the width of the spring lamina (22), each of said pressure pieces engaging and being connected to said upper face of said spring lamina and being spaced from its neighboring pressure pieces (24) by a space which is smaller than the diameter of one of said bolt-shaped pressure members (16).

2. A pressure bar according to claim 1, wherein:

said lamina (22) is made of spring steel.

3. A pressure bar according to claim 1, wherein:

said pressure pieces (24) are adhesively connected to said lamina (22).

4. A pressure bar according to claim 2, wherein:

said pressure pieces (24) are adhesively connected to said lamina (22).

* * * * *